US005875793A

United States Patent [19]

Goto

[11] Patent Number: 5,875,793

[45] Date of Patent: Mar. 2, 1999

[54] HAIR COVER FOR HAIR DYEING TREATMENT

[75] Inventor: Katsuhiko Goto, Osaka, Japan

[73] Assignee: Takara Belmont Kabushiki Kaisha, Osaka, Japan

[21] Appl. No.: 986,408

[22] Filed: Dec. 8, 1997

[30] Foreign Application Priority Data

Aug. 11, 1997 [JP] Japan ..... 9-007092 U
Nov. 7, 1997 [JP] Japan ..... 9-009825 U

[51] Int. Cl.[6] ..... A45D 19/18

[52] U.S. Cl. ..... 132/270; 2/174

[58] Field of Search ..... 132/270, 54, 274, 132/53; 2/174, 195.8

[56] References Cited

U.S. PATENT DOCUMENTS 124,340 3/1872 Dalton ..... 132/274
1,661,141 2/1928 Lipper ..... 132/274
2,199,473 5/1940 Wengen ..... 2/195.8
2,579,089 12/1951 Price ..... 132/274
2,579,945 12/1951 Maupin ..... 2/195.8
2,638,102 5/1953 Goldsmoth ..... 132/274
2,720,883 10/1955 King ..... 132/274

*Primary Examiner*—Todd E. Manahan
*Attorney, Agent, or Firm*—Nikaido, Marmelstein, Murray & Oram LLP

[57] ABSTRACT

A hair cover for hair dying treatment comprises a net-like knitted fabric consisting of a plurality of bands made of an elastic bulky warp. The warp is bent into loops at both sides of the band and crossed reciprocally from left to right so as to longitudinally extend. A plurality of bands are arranged side-by-side and are connected to each other with a thin rubber warp at adjacent bent portions. The bulky warp is preferably a two-ply yarn of polyester filament yarn so that the knitted fabric is soft and elastic. According to one embodiment, forward and rearward ends of the knitted fabric are connected with each other in a tubular shape to form a turban. In another embodiment, the tubular shaped fabric is closed at one end to form a cap.

6 Claims, 4 Drawing Sheets

HAIR COVER FOR HAIR DYEING TREATMENT

FIELD OF THE INVENTION

This invention relates to a hair cover to be put on the head for hair dyeing treatment which can be conveniently used in beauty parlors, barber shops, etc. and is particularly advantageous for partial treatment of hair such as bleaching and coloring.

DESCRIPTION OF THE PRIOR ART

When bleaching or coloring hair, it is often desired that only some bundles of divided hair may be treated without affecting neighboring hair. In such cases, a hair cover B of a plastic film or rubber (so-called frosting cap) as shown in FIG. 5 has been conventionally used. Portions of the hair are drawn out through openings formed therein or pre-formed openings by means of a hooked needle and treated with dyeing agents to attain the desired partial bleaching or coloring.

However, such caps have drawbacks that they are too tight and disagreeable when put on the head. Especially, the rubber cap exerts pressure on the head. Further, repeated uses of the cap are difficult because the cap of a plastic film will be broken by one treatment, while the rubber cap is likely to be dirty since pigmentary deposits on rubber cannot be easily removed. Moreover, most careful attention must be paid not to hurt a head skin with a hooked needle when it is inserted through the openings. There is a further problem that the treatment requires a considerable time.

SUMMARY OF THE INVENTION

It is an object of this invention in view of the above drawbacks to provide a novel hair cover for hair dyeing treatment which can be freely put without pressure on the head and can be repeatedly used. Treatment by the hooked needle can be easily, safely and efficiently conducted with the hair cover according to this invention.

According to this invention, there is provided a hair cover for hair dyeing treatment comprising a net-like knitted fablic consisting of a plurality of bands made of an elastic bulky warp, each said band having bent portions of the warp in loops at both sides, said plurality of bands being arranged side by side and connected to each other with a thin rubber warp at adjacent bent portions.

By employing a twisted thread of polyester filament yarn as said bulky warp, the hair cover according to this invention would not be easily affected by acid dyes in a hair dyeing agent but kept clean even after repeated uses.

If said bulky warp is a two-ply yarn, the hair cover will have better elasticity and high durability.

If a forward and a rearward ends of the knitted fabric are connected in a tubular shape to be worn as a turban or one end of the tubular body is sewed up to form a cap, and various sizes are prepared, it would be possible to speedily choose the hair cover of a shape and a size suitable to a customer's head and effectively save time for the treatment.

BRIEF DESCRIPTION OF THE DRAWINGS

These and other objects, features and advantages of this invention will be made apparent from the following detailed description of the preferred embodiment and example, appended claims and accompanying drawings in which:

DETAILED DESCRIPTION OF PREFERRED EMBODIMENTS

Figure 1:
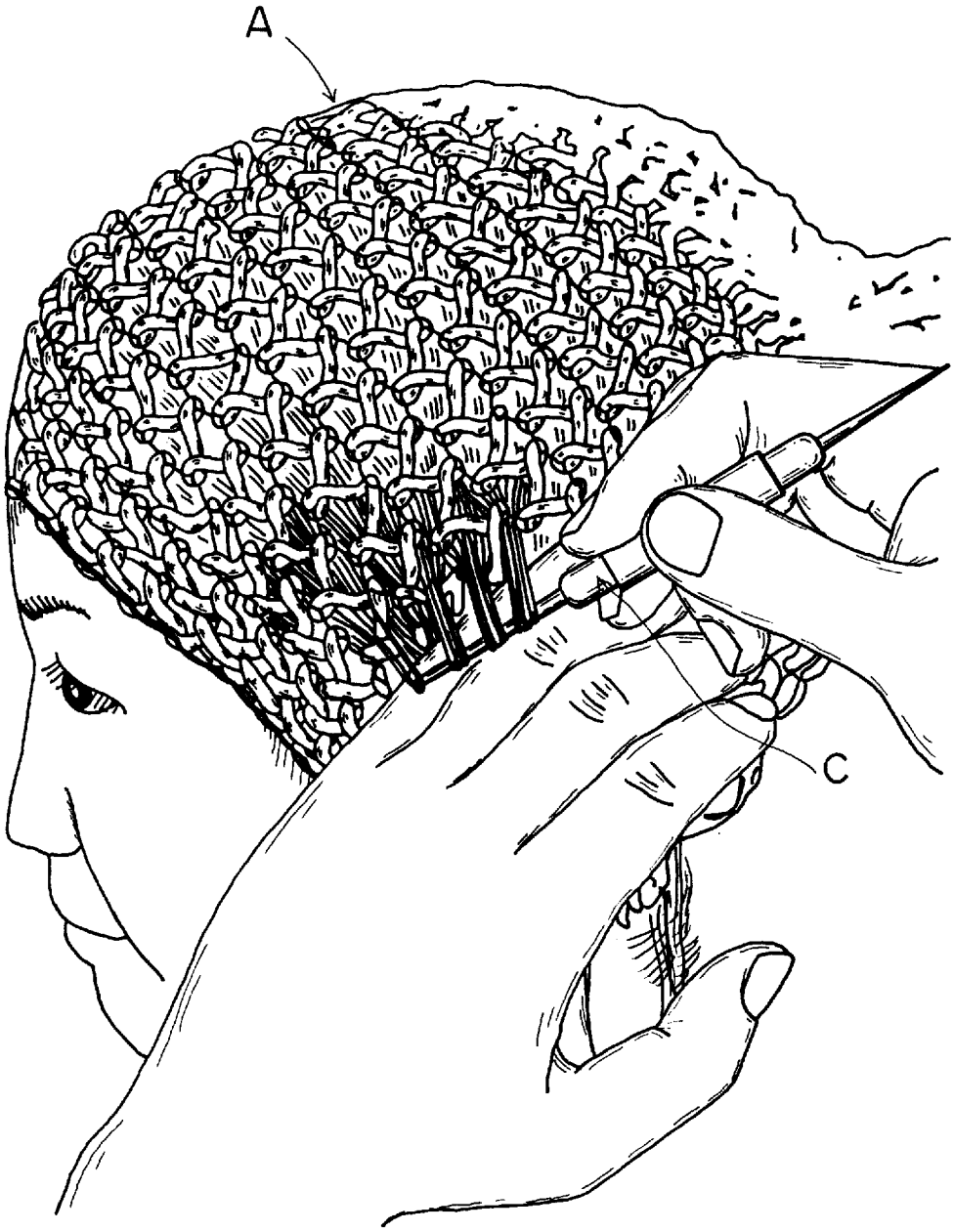
FIG. 1 is a pictorial view of the hair cover for hair dyeing treatment according to this invention put on the head during the treatment.

In FIG. 1 is shown a hair cover A for hair dyeing treatment according to this invention.

Figure 2:
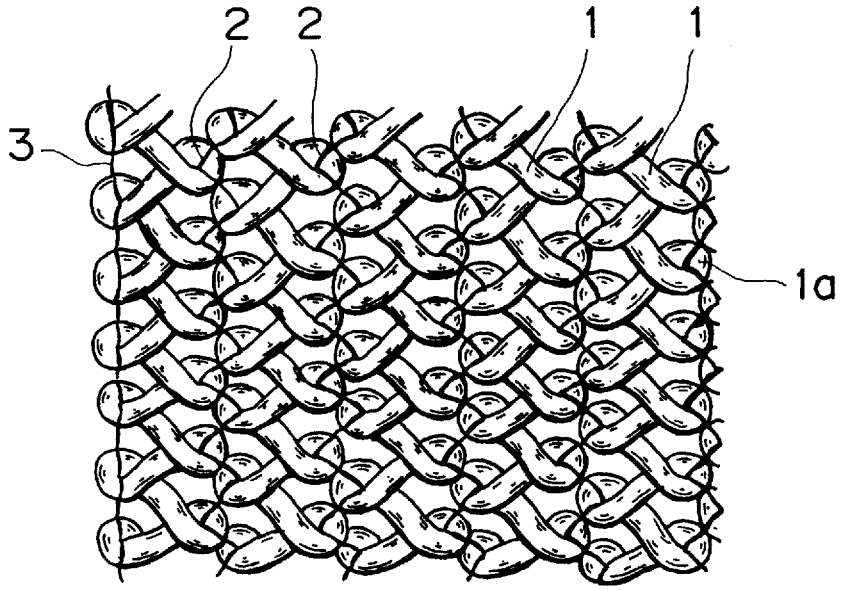
FIG. 2 is an explanatory view of the hair cover in FIG. 1 showing a structure of the knitted fabric constituting the same.

In FIG. 2, reference numeral 1 represents a bulky warp, which is preferably a two-ply yarn obtained by twisting a plurality of polyester filament yarns and by further twisting a plurality of thus twisted yarns in reverse direction. The obtained two-ply yarn has good flexibility and elasticity.

A knitted band is formed with such bulky warp 1 by turning it in closed stitches, i.e., in loops 1*a* at side portions of the band, making it cross reciprocally from left to right to longitudinally extend. A plurality of the thus prepared bands of bulky warps are arranged side by side. Then the loops 1*a* of the adjacent bands are bound by means of a thin rubber warp 2, and the loops 1*a* at the outermost sides are sewed up by means of a rubber binding thread 3 to form an integral knitted fabric.

Figure 3:
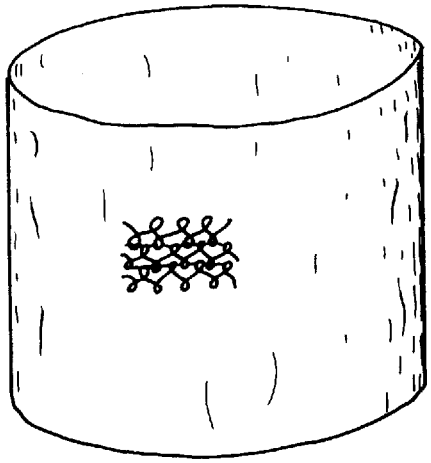
FIG. 3 is a perspective view of one embodiment of the hair cover in this invention in a form of a turban.
Figure 4:
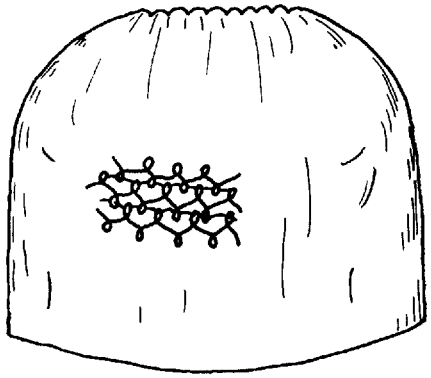
FIG. 4 is a perspective view of another embodiment of the hair cover in a form of a cap.
Figure 5:
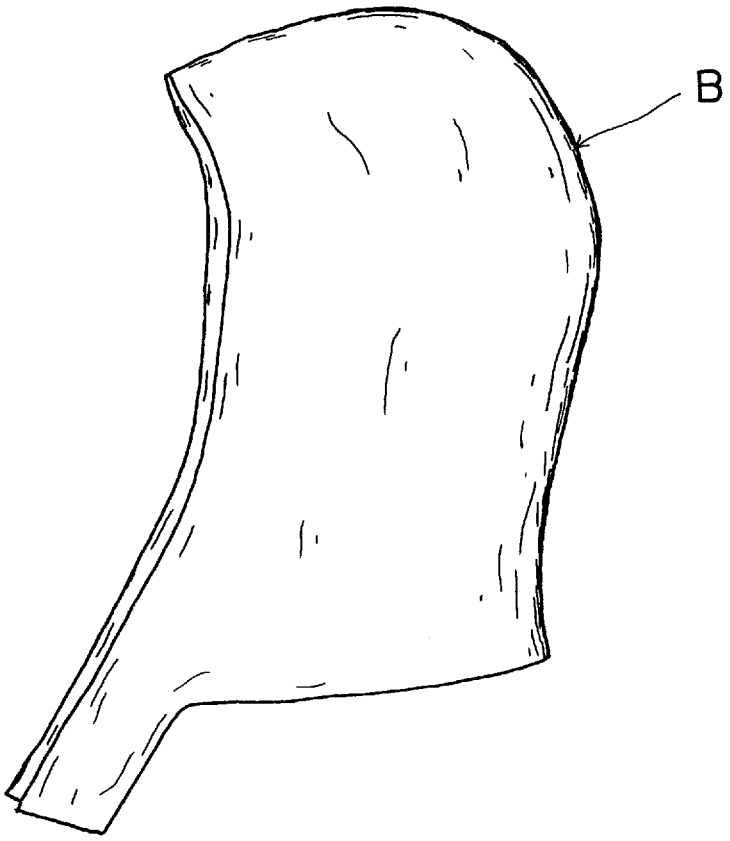
FIG. 5 PRIOR ART
FIG. 5 shows the frosting cap conventionally used for hair dyeing treatment.

The upper and lower ends of the obtained knitted fabric seen in FIG. 2 are connected to each other to form a tubular shaped fabric expandable in either direction, which can be put on the head as a turban as shown in FIG. 3. Further, the above described tubular shaped fabiric is closed at its one end as shown in FIG. 4 to form a cap which can be easily put on the head. In this way, various applications are possible employing the obtained knitted fabric.

The knitted fabric of the above described structure can be expanded as desired either laterally and longitudinally, since the adjacent bulky warps 1 are bound by means of the thin rubber warp 2. Accordingly the hair cover made of such knitted fabric can be easily put on the head, and its stitches can be opened at desired sizes.

EXAMPLE

As the bulky warp 1 is employed a two-ply yarn of 6300 denir obtained by the steps of twisting fourteen polyester filament yarns of 150 denir to form a thread, and twisting in a reverse direction three of the thus formed threads. As the thin rubber warp 2 is employed two of twisted threads of 140 denir obtained by twisting a spandex fiber of 110 denir. About fifteen to twenty bands made of the obtained single bulky warp 1, each band having a width of 12–18 mm are juxtaposed and bound by means of the above-mentioned thin rubber warp 2, thereby forming the knitted fabric whose width and length are 25–30 cm respectively.

Then the forward and rearward ends of the knitted fabric are connected in a tubular shape to form a turban for hair dyeing treatment as shown in FIG. 3.

The knitted fabric in a tubular shape as described above is closed at its one end by sewing or some other means as shown in FIG. 4 thereby to form a cap which is another embodiment of the hair cover for hair dyeing treatment according to this invention.

When the hair cover has been put on the customer's head for bleaching and coloring treatment as shown in FIG. 1, the stitches of the knitted fabric are opened and the hair is softly pressed. A desired amount of the hair are drawn out through the opened stitches by means of the hooked needle C and treated with the desired hair dyeing agent.

As described above, the hair cover for hair dyeing treatment according to this invention is a net-like knitted fabric fabricated by juxtaposing a plurality of bands formed of a single elastic bulky warp which is bent in loops at both sides, then binding the side bent portions of adjacent bands by means of a thin rubber warp. The knitted fabric has extreme elasticity and can reliably wrap the hair at bleaching or coloring without too much pressing the head skin.

Because the stitches can be loosened as desired, manipulation of the hooked needle can be easily conducted without hurting the head skin, the amount of hair to be treated can be controlled selectively, and total time for hair dyeing treatment can be shortened.

Further, the hair cover according to this invention can be used repeatedly because it resists discoloration, thus reducing cost for hair dyeing treatment.

What is claimed is:

1. A hair cover for hair dyeing treatment comprising a net-like knitted fabric consisting of a plurality of bands made of an elastic bulky warp, each said band having bent portions of the warp in loops at both sides, said plurality of bands being arranged side-by-side and connected to each other with a thin rubber warp at adjacent bent portions.

2. A hair cover for hair dyeing treatment as claimed in claim 1 wherein said bulky warp includes a twisted thread of polyester filament yarn.

3. A hair cover for hair dyeing treatment as claimed in claim 1 or 2, wherein said bulky warp includes a two-ply yarn.

4. A hair cover for hair dyeing treatment as claimed in claim 1 or 2, wherein a forward and a rearward ends of said knitted fabric are connected with each other in a tubular shape thereby forming a turban.

5. A hair cover for hair dyeing treatment as claimed in any one of claim 1 or 2, wherein a forward and a rearward ends of said knitted fabric are connected with each other in a tubular shape, said tubular shaped fabric being closed at its one end thereby forming a cap.

6. A hair cover for hair dyeing treatment as claimed in claim 1 or 2, wherein said band is 12–18 mm in width and 25–30 cm in length.

* * * * *